US005256935A

United States Patent [19]

Dobashi et al.

[11] Patent Number: 5,256,935

[45] Date of Patent: Oct. 26, 1993

[54] LOW PRESSURE MERCURY VAPOR DISCHARGE LAMP HAVING COLD CATHODE

[75] Inventors: Yoshitomi Dobashi, Fujisawa; Hisayuki Kobayashi, Iwase, both of Japan

[73] Assignee: Toshiba Lighting & Technology Corporation, Tokyo, Japan

[21] Appl. No.: 751,073

[22] Filed: Aug. 28, 1991

[30] Foreign Application Priority Data

Aug. 30, 1990 [JP] Japan ..... 2-229314
Nov. 26, 1990 [JP] Japan ..... 2-322022

[51] Int. Cl.[5] ..... H01J 61/067; H01J 61.35

[52] U.S. Cl. ..... 313/491; 313/490; 313/488; 313/492; 313/558; 313/566; 313/594; 313/607; 313/631; 313/634

[58] Field of Search ..... 313/491, 488, 492, 494, 313/558, 566, 594, 607, 631, 634, 490, 485

[56] References Cited

U.S. PATENT DOCUMENTS 2,153,009 4/1939 Scott ..... 176/126
4,680,505 7/1987 Funada et al. ..... 313/558
4,767,965 8/1988 Yamano ..... 313/491
4,871,941 10/1989 Dobashi et al. ..... 313/488 X
4,887,002 12/1989 Dobashi et al. ..... 313/607
4,990,828 2/1991 Rabusin ..... 313/558 X

FOREIGN PATENT DOCUMENTS 0200548 8/1989 Japan .
2056344 4/1990 Japan .
482807 4/1938 United Kingdom .

OTHER PUBLICATIONS

Pat. Abstracts of Japan vol. 13, No. 496 Nov. 9, 1989 (2 copies) for JP 1,200,548.

*Primary Examiner*—Donald J. Yusko
*Assistant Examiner*—Ashok Patel
*Attorney, Agent, or Firm*—Ladas & Parry

[57] ABSTRACT

A cold cathode mercury vapor discharge lamp includes a bulb, a support wire within the bulb, and a cathode electrode having a pair of V-shaped electrode portions mounted in spaced, end to end relationship along the support wire. The electrodes include exterior surfaces facing towards the bulb walls, and interior surfaces facing towards the support wire. Getters are mounted on the exterior surfaces, and mercury discharge units are mounted on the interior surfaces. The two electrode portions are non-overlapping along the support wire.

11 Claims, 6 Drawing Sheets

LOW PRESSURE MERCURY VAPOR DISCHARGE LAMP HAVING COLD CATHODE

BACKGROUND OF THE INVENTION

The present invention relates to a cold cathode mercury vapor discharge lamp having a cold cathode and used in liquid crystal apparatus or for backlighting an automobile instrument or the like.

Lamps that use cold cathodes as the electrodes generate a small amount of heat at their electrodes and therefore have a long lamp life, and can also have tube diameters of 15 mm or less since there is a small amount of bulb heating. They are therefore often used for compact fluorescent lamps.

In recent years, the increasing compactness of devices has meant that it has become necessary for this type of cold cathode mercury vapor discharge lamp to have an improved brightness without increasing the size of the cold cathode discharge lamp. One method of improving the brightness is by increasing the discharge current.

However, the maximum permissible current that is supplied to the electrode is determined by the surface area of the electrode and if a discharge current that exceeds this permissible current is supplied, then ion impacting becomes larger, causing an increase in the amount of heat generated at the electrode. Also, because cold cathode mercury vapor discharge lamps generally use the glow discharge region, an increased current causes spattering of the electrode material and consequent deterioration that shortens the life of the electrodes. One means of countering this is by increasing the electrode surface area.

FIG. 1 shows a prior art device made by a method whereby the electrode surface area is increased. This method involves applying a fluorescent substance to the inside walls of the glass bulb 1, baking the bulb and sealing the stems 2 at each end. In addition, to these stems 2 are applied an exhaust tube 3 and through each of the stems 2 are sealed two stem leads 4, each of which is formed of an inner wire 5 and an outer wire 6. In addition, the distal ends of the inner wires 5 have welded to them a V-shaped plate electrode 7. The surfaces of this metal plate 7 have mounted thereon a mercury alloy and a getter.

However, with the cold cathode mercury vapor discharge lamp shown in FIG. 1, the effective electrode surface area is not large and impure substances are formed resulting in the problem of blackening where the electrode material is spattered and adheres to the inner surface of the fluorescent tube. In order to ameliorate this problem, as shown in FIG. 2, for example, two metal plates having different bent angles are welded to the distal ends of the inner wires 5 so that a shape that is fan shape in section is formed. Such an arrangement is shown in Japanese Laid Open Utility Model Application No. 2-56344/1990.

With the configuration shown in FIG. 2, there is little of the above described blackening, but it is impossible to completely prevent such blackening from occurring. In addition, because the gaps between the electrodes are narrow, it is not possible for the electrons to reach the gaps or spaces therebetween. Therefore, the effective area of the electrodes is small.

Also, in such mercury vapor discharge lamps having a compact cold cathode, there is provided a slit portion that allows light to pass along the axis of the bulb, with only light from the slit portion being emitted in a specific direction. These lamps are called aperture type lamps.

In such lamps, the cold cathode mounted at the end of the bulb is formed by welding a cold electrode comprising a metal plate such as nickel, or the like, to wires made of Jumet such as JEMDES (the trade marks of SAES Co. Ltd.) or the like, and with the cold electrode plate formed to a V-shape or a cylinder shape. To surfaces of the cold cathode are mounted a mercury discharge unit that discharges mercury into the discharge space after the lamp has been completed, and a getter comprising phosphorous and barium and a metal such as mercury absorbing indium or the like.

However, when the mercury discharge unit is added to the cold cathode, it is positioned opposite to the aperture portion of the bulb, and when the mercury discharge unit is heated by high-frequency induction to discharge the mercury inside the bulb, the discharged mercury attaches to the aperture (slit) portion.

This adhered mercury causes blackening of the aperture portion and causes such problems as obstructing the passage of light and adversely influencing the distribution of the output light.

SUMMARY OF THE INVENTION

In the light of these problems, the present invention has as a primary object the provision of a cold cathode mercury vapor discharge lamp that has greater brightness and reduced deterioration of the electrode.

In addition, when the present invention is applied to an aperture type discharge lamp, a secondary object of the present invention is the provision of a mercury vapor discharge lamp of the cold cathode aperture type having a reduced amount of mercury adhesion to the aperture portion, and in which blackening of the aperture portion is prevented.

In order to attain these objectives, the present invention is a cold cathode mercury vapor discharge lamp in which a fluorescent substance is applied to the inner walls of the bulb, and in which electrodes are mounted and sealed to each end of the bulb, with each of these electrodes having a plural number of plate shaped electrode portions that are connected to an inner wire with a space between adjacent ones of the plate shaped electrode portions.

The present invention uses a plural number of plate shaped electrode portions, and provides an improved brightness by having a larger surface area of the electrodes, thus allowing an increased discharge current to flow without increasing the diameter of the bulb. In addition, the space between adjacent plate shaped electrode portions is such that there is no overlapping between electrodes, thereby reducing the amount of blackening and preventing deterioration of the electrode.

In order to attain the secondary objective described above, a cold cathode mercury vapor discharge lamp according to the present invention has a mercury discharge unit attached to the cold cathode at a position opposite a portion other than a transparent slit portion of the bulb.

When a fluorescent lamp according to the present invention is applied to an aperture type of fluorescent lamp, the surface to which the mercury discharge unit is attached is remote from the aperture portion of the bulb so even if there is a discharge of mercury from the mercury discharge unit, the mercury does not adhere to the aperture portion through which light passes.

The arrangement of the plural number of plate shaped electrodes with spaces between them and mounting them to the inner wires enlarges the surface area of the electrodes and enables the discharge current to be increased. In addition, the arrangement of spaced apart adjacent electrode portions controls the phenomena of blackening of the electrodes and therefore prevents deterioration of the electrodes.

BRIEF DESCRIPTION OF THE DRAWINGS

In the appended figures.

DETAILED DESCRIPTION OF THE PREFERRED EMBODIMENTS

Figure 3:
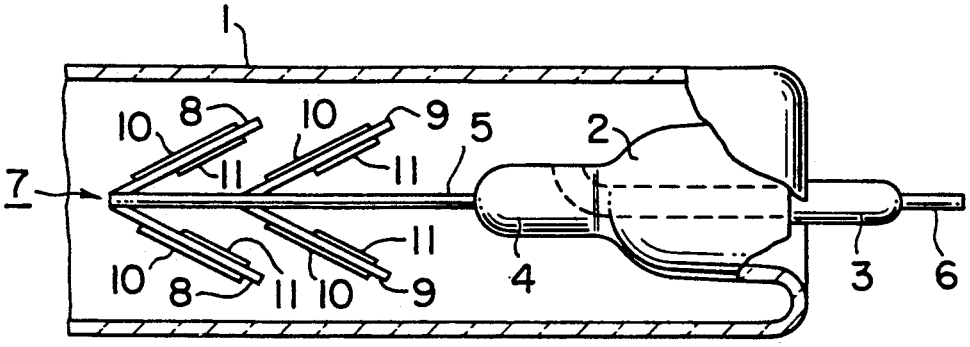
FIG. 3 is a sectional view showing a partial cutaway of a cold cathode mercury vapor discharge lamp according to a first embodiment of the present invention.
Figure 4:
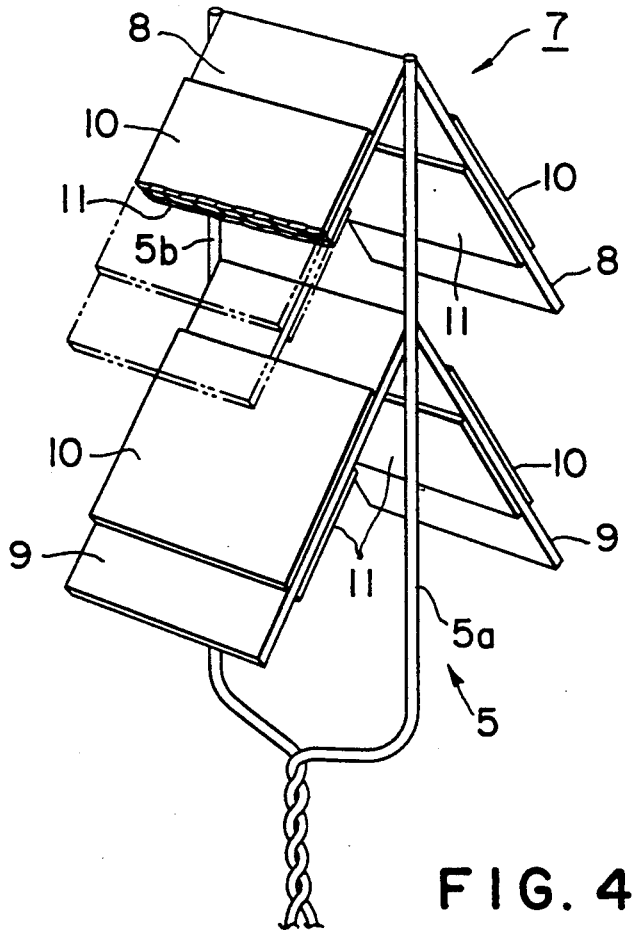
FIG. 4 is an enlarged perspective view of the main portions of a cold cathode mercury vapor discharge lamp according to the first embodiment of the present invention shown in FIG. 3.
Figure 5:
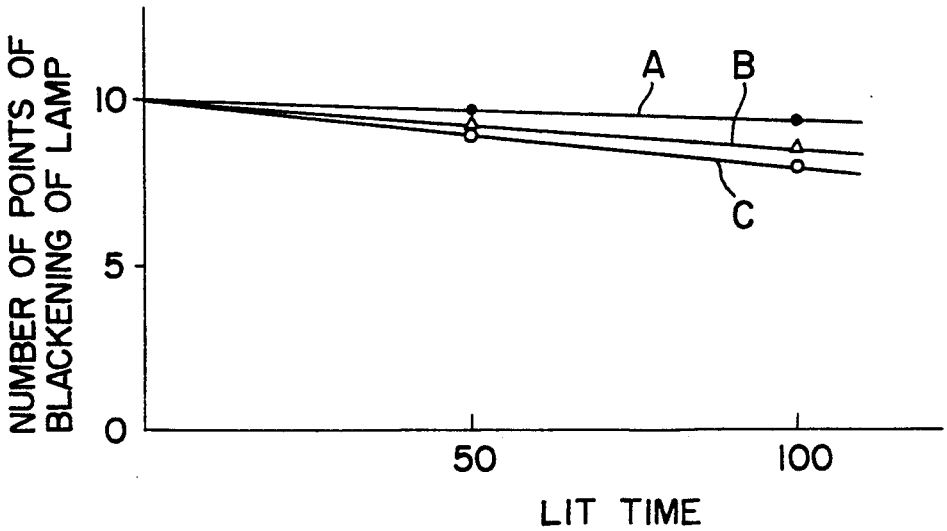
FIG. 5 is a characteristics diagram showing the relationship between the lit time and the number of points of blackening of a lamp according to a first embodiment of the present invention.
Figure 10:
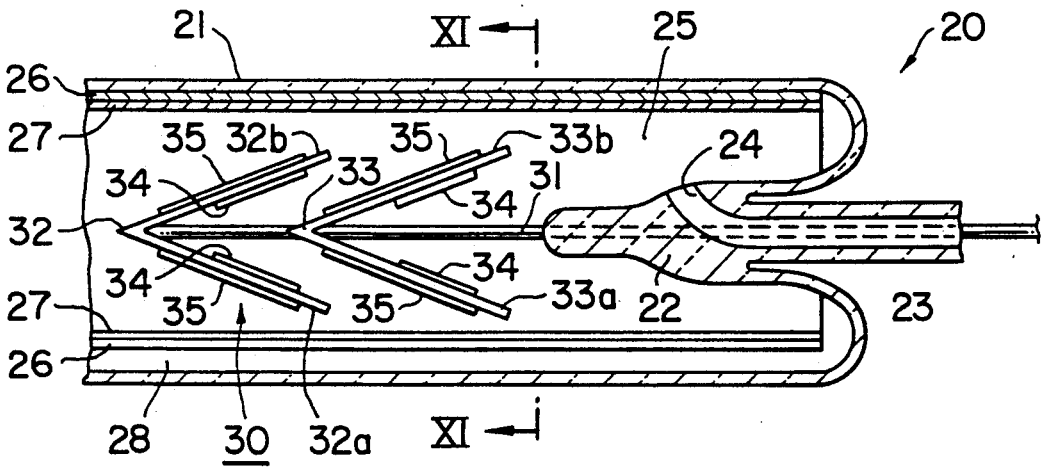
FIG. 10 is a sectional view of an end portion, prior to exhaust, of a cold cathode mercury vapor discharge lamp according to the fourth embodiment shown in FIG. 9.

FIGS. 3 through 5 show a first embodiment of the present invention. First, a fluorescent substance (such as shown in FIG. 10 and identified by reference number 27) is applied to the inner walls of a glass bulb 1 that is cylindrical in shape and having a diameter of 9.5 mm. The coated bulb is then baked and to both ends are mounted and sealed stems 2, and to these stems 2 are mounted exhaust tubes for exhaust.

Each of the stems has sealed therethrough two wires 4 each including an inner wire and an outer wire 6. Furthermore, to the distal ends of the inner 5 wires are mounted two spaced apart flat shaped metal electrode portions 8 and 9 bent to a sideways V-shape. The space between the metal portions 8 and 9 is desirably 2 mm or more. These metal portions 8 and 9 are mounted so that they are substantially parallel and not in contact with each other.

In addition, the outer wire 6 extends from the sealed bulb for connection to a power source or the like.

The metal portions 8 and 9 are inclined at a constant angle with respect to the axis of the tube so as to form a V-shape, whereby the surface area of the plate-shaped electrode 7 formed from the portions 8 and 9 is made larger without widening the diameter of the glass bulb 1. This increase in size of the surface area of the electrode 7 enables the discharge current to be made larger thereby increasing the lamp brightness. Moreover, to the metal portions 8 and 9 that form the plate electrode 7 are respectively provided getters on the outwardly facing surface areas and mercury units 11 on the inwardly facing surface areas.

Moreover, in the case of the first embodiment, as shown in FIG. 4, the inner wires comprise two spaced apart portions 5*a* and 5*b* that sandwich and support the metal portions 8 and 9 from both sides.

Figure 1:
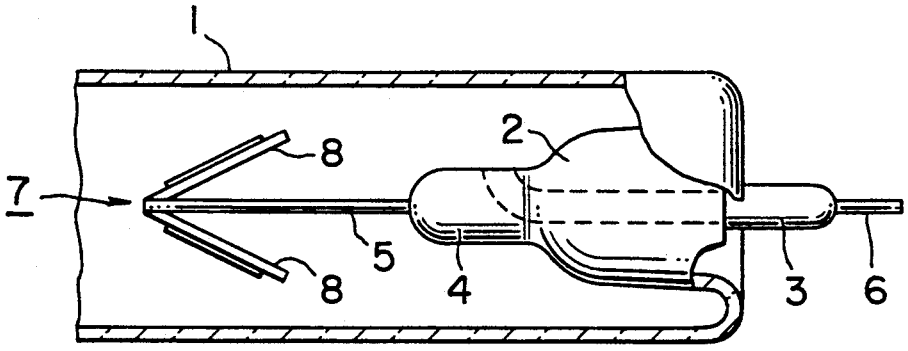
FIG. 1 PRIOR ART
FIG. 1 is a sectional view showing a partial cutaway of a conventional cold cathode mercury vapor discharge lamp.
Figure 2:
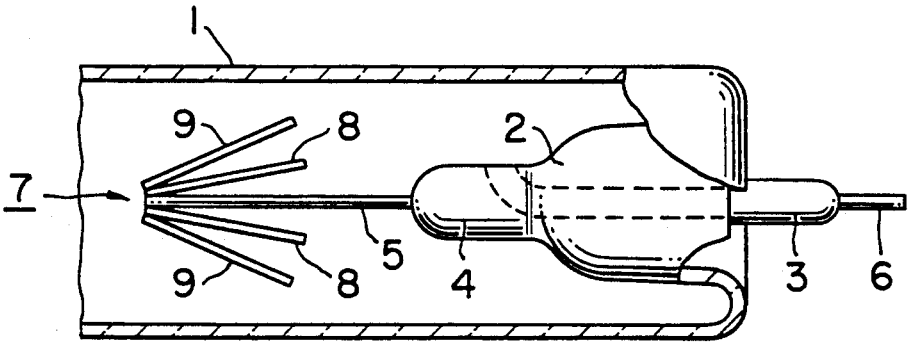
FIG. 2 PRIOR ART
FIG. 2 is a sectional view showing a partial cutaway of a conventional cold cathode mercury vapor discharge lamp that differs from that of FIG. 1.

As shown in FIG. 5, tests for lamp blackening with a lamp current of 10 mA for the conventional lamp shown in FIG. 1 (curve A), and the conventional lamp shown in FIG. 2 (curve B), showed that the number of places of blackening of the lamp of the first embodiment shown in FIG. 3 (curve C) were fewer and that there was less lamp blackening. This is thought to be due to the fact that there is no overlapping, in the axial direction, between the adjacent metal portions 8 and 9 shown in FIG. 3.

Figure 6:
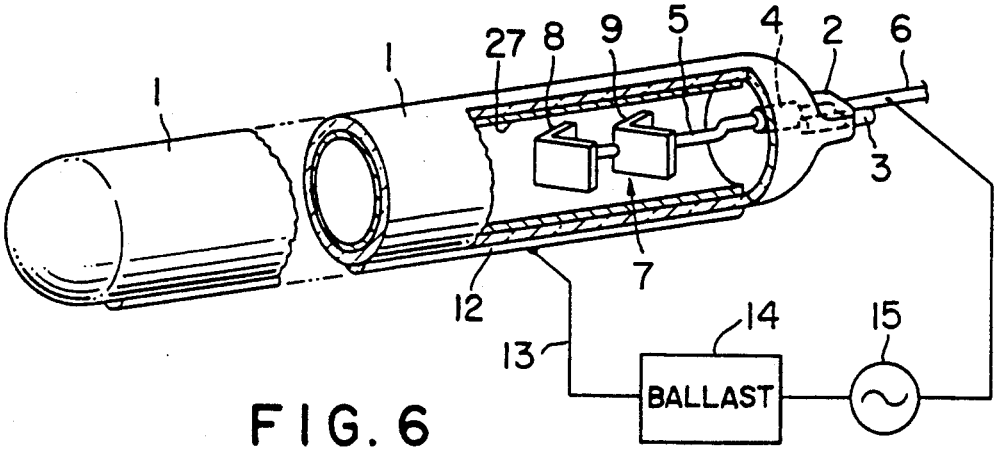
FIG. 6 is a cutaway partial perspective view showing a cold cathode mercury vapor discharge lamp according to a second embodiment of the present invention.
Figure 7:
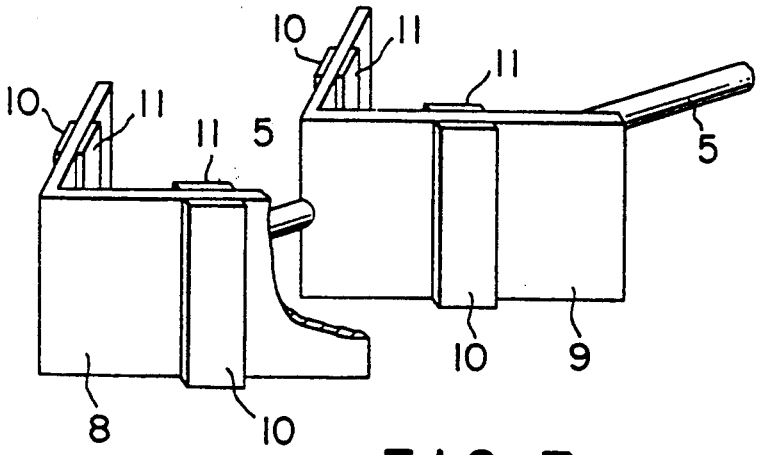
FIG. 7 is a partial perspective view showing the electrodes of a cold cathode mercury vapor discharge lamp according to a second embodiment of the present invention.

In the first embodiment shown in FIG. 3, inner electrodes are provided at both ends of the fluorescent tube. FIGS. 6 and 7 show a cold cathode mercury vapor discharge lamp according to a second embodiment of the present invention where there is an internal electrode at but one end of the tube.

In FIG. 6, the inner electrode 7 is configured similarly to the electrode 7 of the first embodiment shown in FIGS. 3 and 4. Silver (Ag) paste 12 is attached to the outer peripheral surface of a glass tube 1. This silver paste 12 is an external electrode, and a conductor line 13 electrically connects the outer wire 6 and the silver paste 12 with a ballast 14 and a high frequency power source 15. The ballast 14 is to stabilize the power that is supplied from the power source 15, and high-frequency alternating current power of 40 KHz is supplied from the high-frequency power source.

Figure 8:
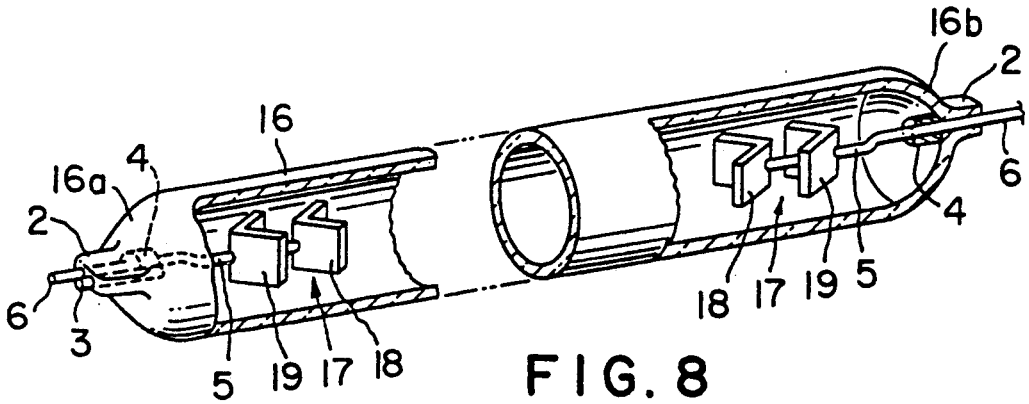
FIG. 8 is a partial perspective view showing a cold cathode mercury vapor discharge lamp according to a third embodiment of the present invention.

In the first and second embodiments described above, the direction of inclination of the plate electrode 7 is away from the center and towards the tube ends so as to form an arrow shape pointing away from the tube ends. The present invention, however, is not limited to this electrode orientation. In FIG. 8, internal V-shaped electrodes 17 comprising metal portions 18 and 19 are symmetrically provided at both ends of the glass tube 20 and positioned such that they widen in the direction away from the ends of the glass tube 20. When the electrodes comprise these widening V-forming portions 18 and 19, the shape of the end portions of the tube 16 can be similarly configured to correspond to the angle of widening of the electrodes 17, and the diameter of the tube increases inwardly from both ends. The lamp thus has a spindle shape, and such shape is useful where there are restrictions relating to the place where the cold cathode mercury vapor discharge lamp is to be installed.

While not illustrated, when both tube ends include inverted V-shaped electrodes, the electrodes at one end of the tube can point (such as electrodes 7 in FIG. 3) away from the one end while the electrodes at the other end can point (as electrodes 17 in FIG. 8) towards the other end.

The following is a description, with reference to FIGS. 9–12, of a cold cathode mercury vapor discharge lamp where the present invention is applied to an aperture type lamp. Here, the term aperture type vapor discharge lamp refers to a lamp including a light emitting window portion formed by applying either a fluorescent substance or a reflecting substance to the wall of the glass tube.

Figure 9:
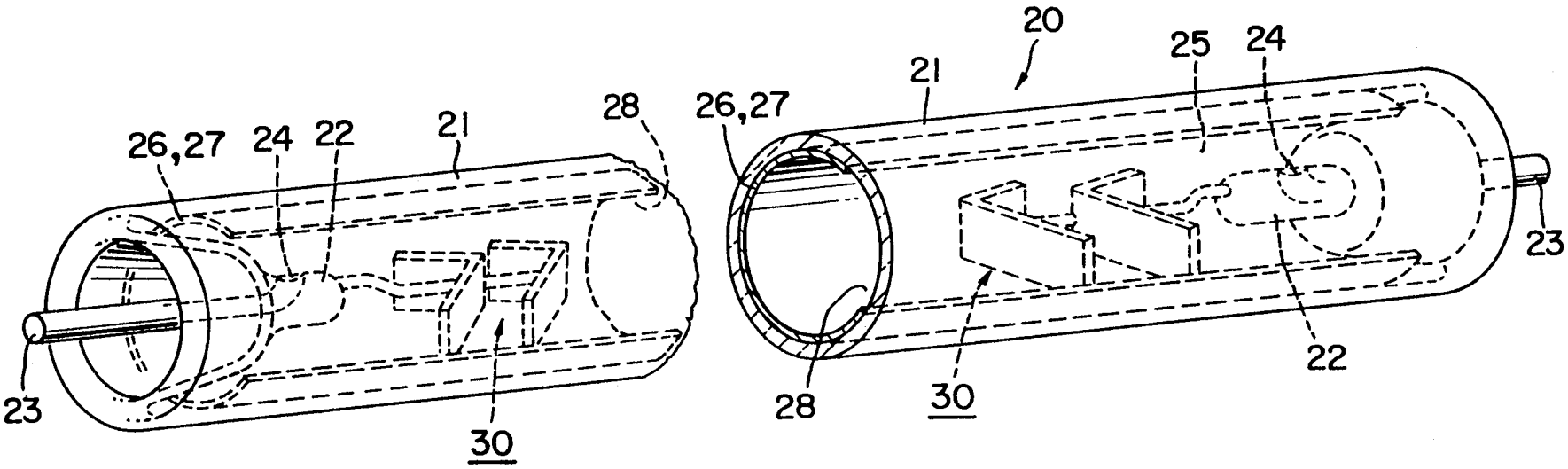
FIG. 9 is a perspective view showing a cold cathode mercury vapor discharge lamp according to a fourth embodiment of the present invention where the invention is applied to an aperture type of fluorescent lamp.

FIG. 9 is a perspective view of the entirety of a cold cathode mercury vapor discharge lamp of the straight tube, aperture type, comprising a straight glass bulb 21 sealed at both ends by flared stems, also shown in FIG. 10.

To the flared stems 22 are connected exhaust tubes, and these exhaust tubes are connected to the inside of the bulb 21, that is, to the discharge space 25, via an exhaust hole 24 formed in the flared stem 22. FIG. 9 shows the status where the exhaust tube 23 is not sealed.

To the inner surface of the bulb 21 is formed a reflector film 26, and to the inside of this reflector film 26 is formed a fluorescent film 27 comprised of material of a halogen or calcium phosphate, for example.

Figure 11:
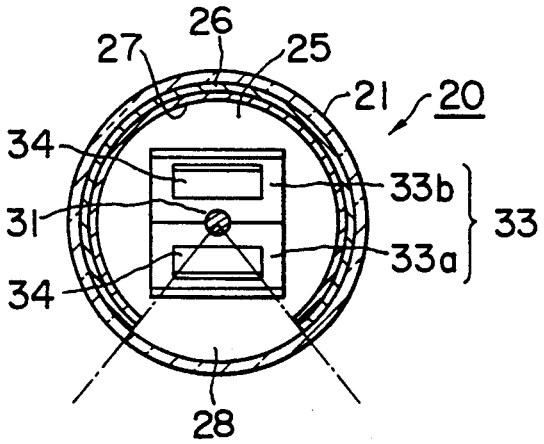
FIG. 11 is a sectional view along the section lines XI—XI of FIG. 10.

In this case, as shown in FIGS. 9 and 11, the inside surface of the bulb has a portion 28 where the fluorescent film 27 and the reflector film 26 are not formed, that is, a passage portion having an opening angle $\theta$ is formed as a band along the axis of the tube. Furthermore, the light inside the bulb 21 is emitted only through this slit portion 28, so the lamp is of the aperture type.

Both ends of the bulb 21 have their respective cold cathodes 30 supported by the stem 22 described above, and are mounted and sealed.

The cold cathodes 30 comprise plates of nickel or the like, and wires 31 (FIG. 10), comprising Jemdes TM wires or the like, connect pairs of the cold cathodes. The wires 30 extend hermetically through the stem 22 and externally of the tube.

Each cold cathode 30 comprises a plate 32 fixed in a V-shape to the distal end of a wire 31, and a V-shaped metal plate 33 fixed along the wire 31 and parallel to the metal plate 32.

The metal plates 32 and 33 have a V-shape pointing away from the stems 22 on which they are mounted.

The outside inclined surfaces of the plates **32*a* and 33*a* are arranged so as to face towards the slit 28 formed in the bulb 21**.

The inclined surfaces **32*a* and 32*b*, and 33*a* and 33*b*, that together form the V-shape of the plates 32 and 33, have adhered to them a mercury discharge unit 34 comprising indium or the like, and a getter 45** comprising phosphorous and barium and the like.

The mercury discharge unit 34 is provided on those of the inclined surfaces **32*a* and 32*b*, and 33*a* and 33*b* which are inner surfaces. More specifically, the mercury discharge units 34 are positioned to avoid facing towards the slit portion 28 of the bulb 21 or towards electrode surfaces facing towards the discharge space 25**.

On the other hand, the getters 35 are mounted on the outer surfaces of the plates 32 and 33, that is, on the surfaces that face towards the discharge space 25.

Within the discharge space 25 of the bulb 21 is included a starter rare gas such as argon or the like.

In a cold cathode mercury vapor discharge lamp having the described configuration, there is no blackening of the slit portion 28, whereby early blackening of the bulb 21 is prevented, the light flux maintenance ratio is improved, and there is no flickering when the lamp is lit.

More specifically, with a lamp having the configuration as described above, the inclined plates **32*a* and 33*a* are arranged so as to face towards the slit 28 formed in the bulb 21, and on the inner surfaces of these inclined plates 32*a* and 33*a*, as well as on the inner surfaces of the plates 32*b* and 33*b*, are mounted mercury discharging units 34 of indium, for example. During high frequency induction heating for discharging the mercury inside the bulb 21, the mercury dispersed from the mercury discharging units 34 is interrupted by one of the plates 32*a* and 33*a* and does not directly adhere to the slit portion 28**.

Because of this, there is no attachment of mercury to the light emitting slit portion 28, thereby preventing blackening of the portion and the attendant disruption of the distribution of the light through the slit portion 28.

In addition, the air inside the bulb 21 is drawn through the exhaust tube 23 during the lamp exhaust process and is led outside the bulb 21. In the FIG. 10 lamp, the flow of air inside the bulb 21 is mainly along the outer surfaces of the V-shaped plates 32 and 33, that is, the surfaces that face towards the discharge space 25. However, because the mercury discharge units 34 are placed on the inner surfaces of the plates 32 and 33, the mercury discharge units 34 contact only a small proportion of the air that is exhausted. Because of this, the mercury discharge units 34 are less contaminated by the atmosphere and are less likely to form mercury oxide substances for discharge into the discharge space during the later high-frequency heating. As a result, after completion of the lamp, there is little adhesion of mercuric oxides to the walls of the bulb, thereby preventing early blackening of the lamp. The light flux maintenance ratio is therefore improved accordingly.

Figure 12:
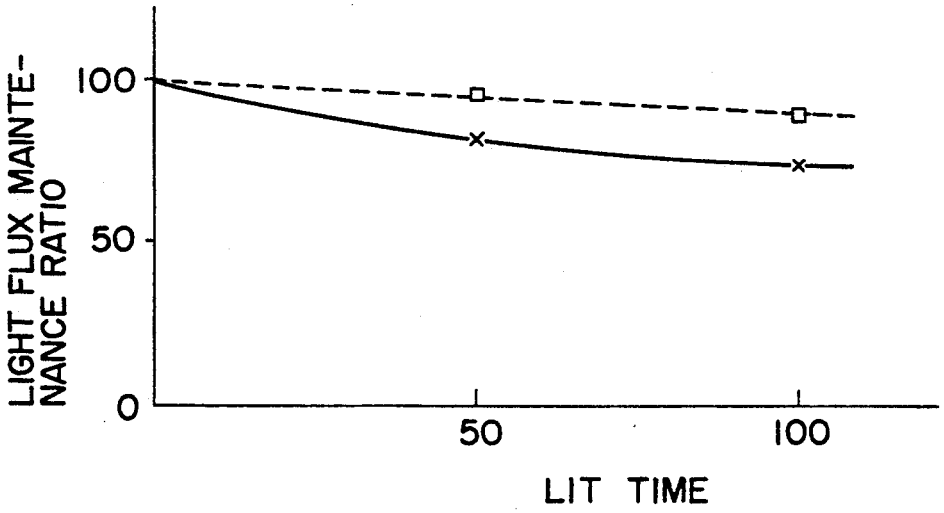
FIG. 12 is a characteristics diagram showing the light flux maintenance ratio with respect to time lit, for a lamp according to a fourth embodiment of the present invention.

FIG. 12 is a characteristics diagram showing the results of light flux maintenance ratio testing for the configuration of the fourth embodiment. In FIG. 12, the solid line $A_o$ is the light flux maintenance ratio for the case of the structure of the inventive embodiment described above, and the broken line $B_o$ is the light flux maintenance ratio for a prior art lamp where the mercury discharge unit is formed on the outer side of the cold cathode.

In addition, when the lamp in accordance with the prior art is formed with the mercury discharge unit on the outer surface of the cold cathode 30, the surface that faces the discharge space is covered by the mercury discharge unit. In this case, the indium to which the mercury is bound is lacking an electron discharge function and has a high work function when compared to the cold cathode 30 that is comprised of nickel, and it is difficult for spots to generate on the side of the outer surface of the cold cathode when the lamp is lit. In addition, the spots do not appear at one defined place, but are observed to move and to cause flickering.

Testing has shown that this flickering is caused largely by the gap between adjacent metal plates.

In the lamp shown in FIG. 10, the getter 35 is attached to the electrode surface facing the discharge space 25, so there is a better electron discharge function when compared to the mercury discharge 34 and there is little motion of the spots on the outer surface of the plates 32 and 34 when the lamp is lit. Thus flickering is reduced.

Moreover, in the lamp shown in FIG. 6, the cold cathode 30 comprised of nickel plates 32 and 33 becomes finer on the side of the discharge space 25 so that the side of the step 22 on the opposite side widens to form a V-shape, but the present invention is not limited to this.

More specifically, the cold cathode can be of a hollow conical (umbrella) shape with the mercury discharge unit 34 mounted on the inner side.

In addition, it is also possible to form the cold cathode in a cylindrical shape from nickel. More specifically, with a cold cathode of a cylindrical shape, no matter where the mercury discharge unit is provided on the inner surface, the mercury discharge is surrounded by the cylindrical cold cathode and does not attach to the bulb. A getter can also be provided on the outer surface in this case.

In addition, the present invention is not restricted to straight tube cold cathode mercury vapor discharge lamps and can be applied to cold cathode mercury vapor discharge lamps having tubes that are shaped as rings, as letter U shapes, as letter W shapes or any other type of curve.

Also, the structure for sealing the bulb is not limited to the flare system, and can be a structure of the button system or the pinch seal system.

Figure 13:
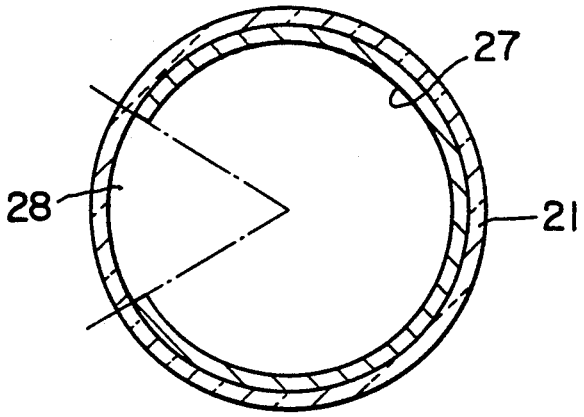
FIGS. 13 through 15 are sectional views showing various modifications of aperture types of mercury discharge vapor lamps according to the fourth embodiment.

Still furthermore, in the aperture type of cold cathode mercury vapor discharge lamp of the fourth embodiment, various modifications are possible for the formation of the aperture portion. More specifically, FIG. 13 shows an aperture portion formed by a gap 28 in a fluorescent covering film 27 applied to the inner wall surface of a glass bulb 21.

Figure 14:
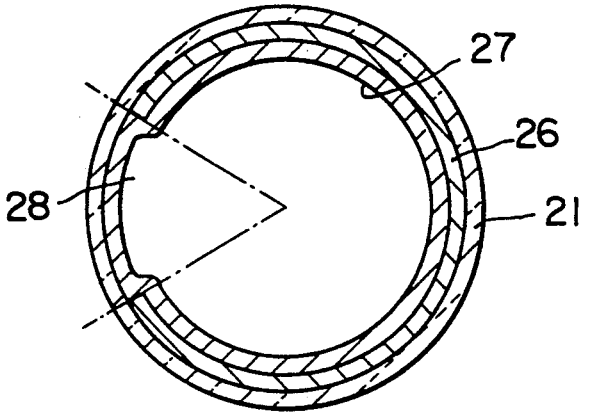

The glass bulb 21 shown in FIG. 14 has a reflector film 26 applied to the inner wall surface of a glass bulb 21 but not over a slit portion formed in the direction of the axis of the tube. The inside surface of the reflector film 26 and the entire tube wall of the slit portion are covered by a fluorescent covering film 27. Accordingly, the slit portion that is not covered by the reflector film 26 becomes the aperture portion 28.

Figure 15:
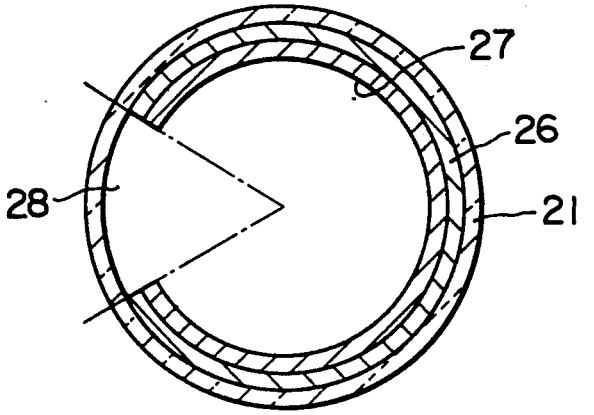

In FIG. 15 the reflector film 26 and the fluorescent film 28 are successively applied except over the slit portion an aperture 28.

Moreover, within the discharge space 25 of the bulb 21 is included a starter rare gas such as argon or the like.

What is claimed is:

1. A cold cathode mercury vapor discharge lamp comprising a bulb having a transparent wall portion and containing mercury vapor, an electrode sealed within said bulb, a luminescent coating material disposed on an interior surface of said bulb, and a first electrode support provided within said bulb, said support being secured to a section of a wall of said bulb and extending in a direction from said wall section, said electrode comprising first and second parallel plates spaced apart along said direction and secured to respective portions of said support spaced apart along said direction, and said parallel plates being inclined to said support.

2. A lamp according to claim 1, further including an electrode disposed on an exterior surface of said bulb.

3. A lamp according to claim 1, wherein said support comprises a straight wire, and said support portions are spaced apart a distance substantially equal to the spacing between said parallel plates along said direction.

4. A lamp according to claim 1, including second and third plates each secured to said support at said respective portions and forming, in combination with respective ones of said first and second plates, V-shaped electrode portions.

5. A lamp according to claim 4, wherein said support is secured to and extends from one end of said bulb, said V-shaped electrode portions point away from said one end, and said bulb has a spindle shape with said one end forming one end of the spindle shape.

6. A lamp according to claim 4, including a second support, said first and second supports being secured to and extending from respective opposite ends of said bulb and each support supporting a pair of said V-shaped electrode portions thereon.

7. A lamp according to claim 6, wherein the V-shaped portions at said opposite ends of said bulb point towards one another.

8. A lamp according to claim 6, wherein the V-shaped portions at said opposite ends of said bulb point away from each other.

9. A lamp according to claim 4, wherein said V-shaped electrode portions are non-overlapping of each other in directions perpendicular to said direction.

10. A lamp according to claim 4, wherein said plates each has, with respect to the V-shaped electrode portion of which it is a part, an interior surface facing towards said support and an exterior surface facing directly towards a wall of said bulb, a mercury discharge unit mounted on an interior surface of one of said plates, and a getter mounted on an exterior surface of one of said plates.

11. A lamp according to claim 10, wherein said transparent wall portion comprises a transparent window through an otherwise opaque bulb wall, and the exterior surface of the one plate on the interior surface of which is mounted said mercury discharge unit faces towards said window for blocking straight line access of mercury discharged from said unit to said window.

* * * * *